US010801531B2

(12) United States Patent
Kawabuchi et al.

(10) Patent No.: US 10,801,531 B2
(45) Date of Patent: Oct. 13, 2020

(54) UNLOAD CIRCUIT

(71) Applicant: TADANO LTD., Kagawa (JP)

(72) Inventors: Naoto Kawabuchi, Kagawa (JP); Naofumi Yoshida, Kagawa (JP); Yasuhiro Fukumori, Kagawa (JP)

(73) Assignee: TADANO LTD., Kagawa (JP)

( * ) Notice: Subject to any disclaimer, the term of this patent is extended or adjusted under 35 U.S.C. 154(b) by 183 days.

(21) Appl. No.: 16/085,767

(22) PCT Filed: Mar. 24, 2017

(86) PCT No.: PCT/JP2017/012015
§ 371 (c)(1),
(2) Date: Sep. 17, 2018

(87) PCT Pub. No.: WO2017/164370
PCT Pub. Date: Sep. 28, 2017

(65) Prior Publication Data

US 2019/0113031 A1 Apr. 18, 2019

(30) Foreign Application Priority Data

Mar. 24, 2016 (JP) ..... 2016-059486

(51) Int. Cl.
*F15B 19/00* (2006.01)
*F15B 20/00* (2006.01)
(Continued)

(52) U.S. Cl.
CPC ..... *F15B 19/005* (2013.01); *F15B 20/00* (2013.01); *F15B 20/004* (2013.01);
(Continued)

(58) Field of Classification Search
CPC ..... F15B 19/005; F15B 20/00; F15B 20/008; F04B 49/035; F04B 49/08
See application file for complete search history.

(56) References Cited

U.S. PATENT DOCUMENTS 6,087,945 A * 7/2000 Yasuda ..... E02F 9/2235 116/168
9,528,245 B2 * 12/2016 Goto ..... E02F 9/123
2019/0085876 A1 * 3/2019 Kawabuchi ..... F15B 20/002

FOREIGN PATENT DOCUMENTS

JP H07-285787 A 10/1995
JP 2014-125774 A 7/2014
KR 10-0736719 B1 7/2007

OTHER PUBLICATIONS

Jun. 6, 2017, International Search Report issued for related PCT application No. PCT/JP2017/012015.
(Continued)

*Primary Examiner* — Michael Leslie
(74) *Attorney, Agent, or Firm* — Paratus Law Group, PLLC

(57) ABSTRACT

The unload circuit includes a pump oil passage that connects between a hydraulic pump and a direction control valve, a tank oil passage that connects between the direction control valve and a hydraulic tank, a pressure compensating flow control valve interposed between the pump oil passage and the tank oil passage, a pilot operated relief valve interposed between the pump oil passage and the tank oil passage, and an unloading solenoid valve interposed in a vent oil passage of the pilot operated relief valve. The failure diagnosis device includes a pressure sensor that measures a pressure of the pump oil passage, and a controller that receives a pressure signal from the pressure sensor. The controller performs failure diagnosis of the unload circuit based on a differential pressure between a first pump oil passage pressure during unloading and a second pump oil passage pressure during on-loading.

4 Claims, 5 Drawing Sheets

(51) Int. Cl.

| | |
|---|---|
| *B66C 23/90* | (2006.01) |
| *F15B 11/028* | (2006.01) |
| *E02F 9/24* | (2006.01) |

(52) U.S. Cl.
CPC ..... *F15B 20/008* (2013.01); *B66C 23/90* (2013.01); *B66C 23/905* (2013.01); *E02F 9/24* (2013.01); *F15B 11/028* (2013.01)

(56) References Cited

OTHER PUBLICATIONS

Jun. 6, 2017, International Search Opinion issued for related PCT application No. PCT/JP2017/012015.
Oct. 24, 2019, European Search Report issued for related EP Application No. 17770410.3.

* cited by examiner

UNLOAD CIRCUIT

CROSS REFERENCE TO PRIOR APPLICATION

This application is a National Stage Patent Application of PCT International Patent Application No. PCT/JP2017/012015 (filed on Mar. 24, 2017) under 35 U.S.C. § 371, which claims priority to Japanese Patent Application No. 2016-059486 (filed on Mar. 24, 2016), which are all hereby incorporated by reference in their entirety.

TECHNICAL FIELD

The present invention relates to a failure diagnosis device for an unload circuit which suspends an operation of a construction machine.

BACKGROUND ART

In general, an actuator of a construction machine is driven by a hydraulic system. The hydraulic system is provided with an unload circuit for returning hydraulic oil from a hydraulic pump to a hydraulic tank with no load by branching off from a pump circuit that connects the hydraulic pump and a direction control valve to each other (for example, FIG. 2 of Patent Literature 1).

The unload circuit is provided in a hydraulic system of a mobile crane belonging to a field of the construction machine. The mobile crane is provided with a safety device that constantly monitors a stability limit or a strength limit of the mobile crane during operation in order not to exceed the stability limit or not to exceed the strength limit during crane operation. Further, in a case of exceeding the limit, the unload circuit is operated by the safety device to automatically suspend an operation of an actuator (for example, a derricking cylinder) of the mobile crane, thereby ensuring safety.

CITATION LIST

Patent Literature

Patent Literature 1: JP 2014-125774 A

SUMMARY OF THE INVENTION

Problems to be Solved by the Invention

However, when the unload circuit has failure, the actuator is not automatically stopped during the crane operation, and the stability limit or the strength limit is exceeded, which may lead to overturning or damage of the mobile crane.

An object of the invention is to provide a failure diagnosis device capable of surely finding failure of an unload circuit in a hydraulic system.

Solutions to Problems

A failure diagnosis device according to the present invention is a failure diagnosis device for an unload circuit, the unload circuit including a pump oil passage for communication between a hydraulic pump and a direction control valve, a tank oil passage for communication between the direction control valve and a hydraulic tank, a pressure compensating flow control valve interposed between the pump oil passage and the tank oil passage, a pilot operated relief valve interposed between the pump oil passage and the tank oil passage, and an unloading solenoid valve interposed in a vent oil passage of the pilot operated relief valve, the failure diagnosis device including:

a pressure sensor that measures a pressure of the pump oil passage; and a controller that receives a pressure signal from the pressure sensor, wherein the controller performs failure diagnosis of the unload circuit based on a differential pressure between a first pump oil passage pressure during unloading and a second pump oil passage pressure during on-loading.

Effects of the Invention

According to a failure diagnosis device of the present invention, it is possible to surely find failure of an unload circuit in a hydraulic system. Therefore, safety and reliability of a construction machine mounted with a hydraulic system are remarkably improved.

DESCRIPTION OF EMBODIMENTS

Figure 1:
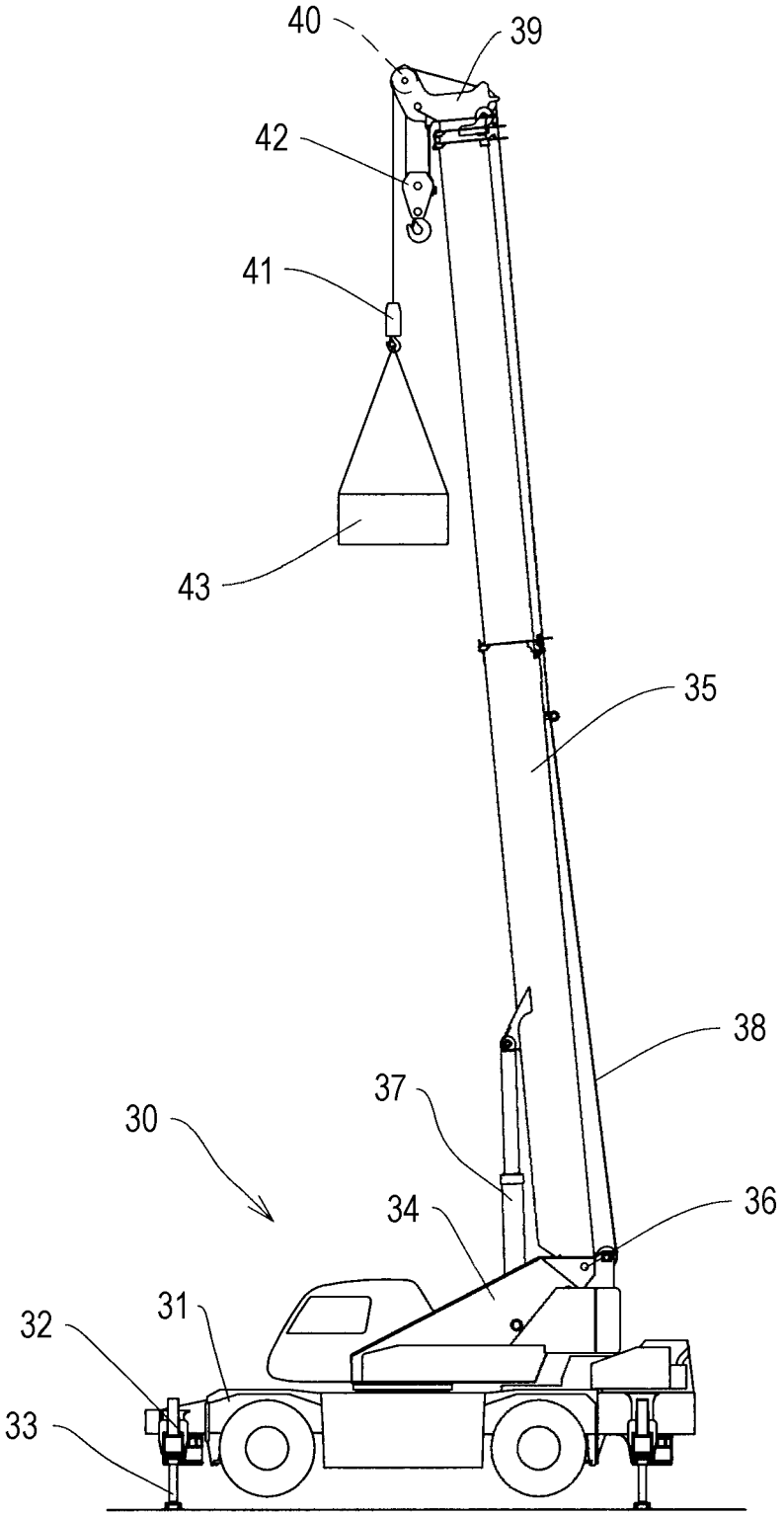
FIG. 1 is a diagram illustrating an operation state of a mobile crane.

FIG. 1 illustrates a state of a mobile crane 30 during a crane operation as a suitable example of a construction machine mounted with a failure diagnosis device of the present invention. In FIG. 1, the mobile crane 30 is in a crane operation posture in which jack cylinders 33 of outriggers 32 provided at a front and a rear of a lower frame 31 are extended to jack the entire mobile crane 30 up.

A swivel base 34 is pivotally mounted on an upper surface of the lower frame 31. A telescopic boom 35 is connected to the swivel base 34 by a pin 36 such that derricking motion is allowed. The telescopic boom 35 is driven by a derricking cylinder 37 to be lifted and lowered with respect to the swivel base 34.

The telescopic boom 35 is driven by a telescopic cylinder (not illustrated) disposed therein to expand and contract. A wire rope 38 is unreeled from a winch (not illustrated) disposed on the swivel base 34 and guided to a distal end 39 of the telescopic boom along a rear surface of the telescopic boom 35. Further, the wire rope 38 is wound around a sheave 40 of the distal end 39 of the telescopic boom, and a hook 41 is hung at a tip thereof. A suspended load 43 is hung on the hook 41. A hook 42 is hung on a wire unreeled from another winch disposed on the swivel base 34.

The mobile crane 30 is stably supported by the four jack cylinders 33 of the outrigger 32. In this instance, a strength state of each part of the mobile crane 30 is within a limit. When the derricking cylinder 37 is contracted and the telescopic boom 35 is laid down from this crane operation posture, an operation radius of the suspended load 43 increases. Accordingly, a stable state of the mobile crane 30 approaches a predetermined stability limit, and the strength state of each part of the mobile crane 30 approaches a predetermined strength limit. When the stable state approaches the stability limit or the strength state approaches the strength limit, the safety device of the mobile crane 30 works and the unload circuit in a hydraulic system of the derricking cylinder 37 operates. In this way, an operation of laying down the telescopic boom 35 is automatically suspended, so that the stability limit or the strength limit is not exceeded.

Figure 2:
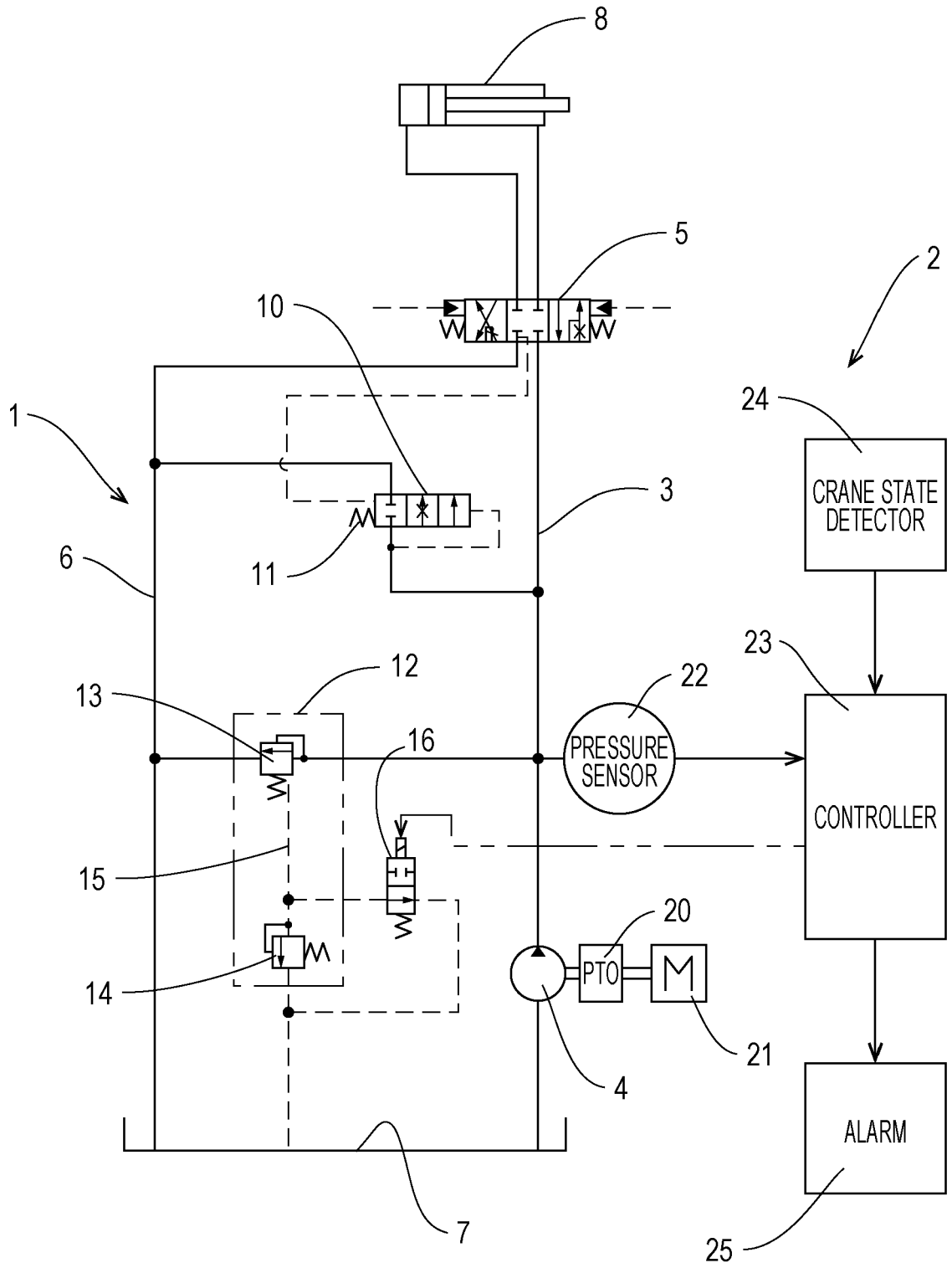
FIG. 2 is a diagram illustrating an example of a hydraulic system of the mobile crane.

FIG. 2 is a diagram illustrating an example of the hydraulic system of the mobile crane 30. The hydraulic system includes a hydraulic circuit 1 for driving a hydraulic actuator 8 of the mobile crane 30. The hydraulic circuit 1 is configured as an unload circuit (hereinafter referred to as an "unload circuit 1") capable of circulating hydraulic oil with no load when the hydraulic actuator 8 is not operated. In FIG. 2, the unload circuit 1 is in an unloaded state.

The unload circuit 1 includes a pump oil passage 3, a hydraulic pump 4, a direction control valve 5, a tank oil passage 6, a hydraulic tank 7, a pressure compensating flow control valve 10, a pilot operated relief valve 12, and an unloading solenoid valve 16. The unload circuit 1 is kept in an on-load state during a normal crane operation and switched to the unloaded state when the safety device 2 detects that the stability limit or the strength limit is close.

A driving direction of the direction control valve 5 is switched by a pilot pressure, and the direction control valve 5 controls hydraulic oil from the hydraulic pump 4 to supply the hydraulic oil to the hydraulic actuator 8. The direction control valve 5 is a closed center type control valve in which all ports are closed when the pilot pressure is not supplied.

The pump oil passage 3 connects the hydraulic pump 4 and the direction control valve 5 to each other. The tank oil passage 6 connects the direction control valve 5 and the hydraulic tank 7 to each other. The hydraulic actuator 8 is driven by the direction control valve 5 supplying the hydraulic oil from the hydraulic pump 4 to one of oil chambers.

The pressure compensating flow control valve 10 is interposed between the pump oil passage 3 and the tank oil passage 6 to keep a pressure difference between an inlet and an outlet of the direction control valve 5 constant (pressure compensation). In this way, even when an operating pressure fluctuates due to a change in load of the hydraulic actuator 8, hydraulic oil is supplied to the hydraulic actuator 8 at a predetermined flow rate corresponding to an opening degree of the direction control valve 5.

A lot of hydraulic actuators 8 are mounted on the mobile crane 30. However, FIG. 2 illustrates a case in which the hydraulic actuator 8 includes a hydraulic cylinder (for example, the derricking cylinder 37 illustrated in FIG. 1).

The pilot operated relief valve 12 has a parent valve 13, a child valve 14, and a vent oil passage 15 and is interposed between the pump oil passage 3 and the tank oil passage 6. The child valve 14 is interposed in the vent oil passage 15 of the parent valve 13. In the pilot operated relief valve 12, a pilot operation of the parent valve 13 is performed by a setting pressure of the child valve 14 provided in the vent oil passage 15. Thus, relief performance is excellent, and the pressure is easily controlled.

The unloading solenoid valve 16 is provided in the vent oil passage 15 to bypass the child valve 14. As illustrated in FIG. 2, the unloading solenoid valve 16 switches to a communication side (a state in which an output port and an input port are in communication) at the time of being de-energized and bypasses the child valve 14. On the other hand, the unloading solenoid valve 16 switches to a cutoff side (a state in which the output port and the input port are cutoff) upon being energized (see FIG. 5).

In FIG. 2, since the unloading solenoid valve 16 corresponds to the communication side, and the vent oil passage 15 communicates with the hydraulic tank 7, a vent oil passage pressure becomes 0 and the parent valve 13 opens. For this reason, hydraulic oil discharged from the hydraulic pump 4 flows into the tank oil passage 6 from the pump oil passage 3 through the parent valve 13 of the pilot operated relief valve 12, and returns to the tank (so-called unloaded state).

The hydraulic pump 4 is connected to an engine 21 through a power take-off (PTO) 20. The PTO 20 transmits power of the engine 21 to the hydraulic pump 4.

The safety device 2 has a pressure sensor 22, a controller 23, a crane state detector 24, and an alarm 25.

The pressure sensor 22 is installed in the pump oil passage 3 to measure a pressure of the pump oil passage 3 (hereinafter referred to as a "pump oil passage pressure"). A pressure signal of the pressure sensor 22 is sent to the controller 23. Failure diagnosis of the unload circuit 1 is performed based on the pressure signal from the pressure sensor 22. The failure diagnosis of the unload circuit 1 is performed according to a diagnostic flow described below.

The alarm 25 is disposed in an operator cab (reference symbol is omitted) of the mobile crane 30 to issue an alarm in accordance with an alarm signal from the controller 23. The controller 23 outputs an alarm signal to the alarm 25 based on the pressure signal from the pressure sensor 22 when the unload circuit 1 is diagnosed as failure.

The crane state detector 24 detects a posture and a load of the crane during the crane operation of the mobile crane 30. Specifically, the load is detected based on an overhand width of the outrigger 32, a turning angle of the swivel base 34, an expansion/contraction length and a hoisting angle of the telescopic boom 35, and the suspended load 43. A detection result is sent to the controller 23 as a crane state signal (posture and load of the crane).

During crane operation of the mobile crane 30, the controller 23 receives the crane state signal from the crane state detector 24 at all times. In addition, the controller 23 stores data of a stability limit and a strength limit for each operation posture of the crane and compares the data with the received crane state signal.

When the mobile crane 30 is likely to exceed the stability limit or the strength limit, the controller 23 switches the unloading solenoid valve 16 to the communication side by suspending energization with respect to the unloading solenoid valve 16. Then, the vent oil passage 15 communicates with the hydraulic tank 7, and the hydraulic oil from the pump oil passage 3 flows to the tank oil passage 6 via the parent valve 13 of the pilot operated relief valve 12. That is, the unload circuit 1 is in the unloaded state. In this way, since the hydraulic oil does not flow to the hydraulic actuator 8, the mobile crane automatically stops.

Figure 3:
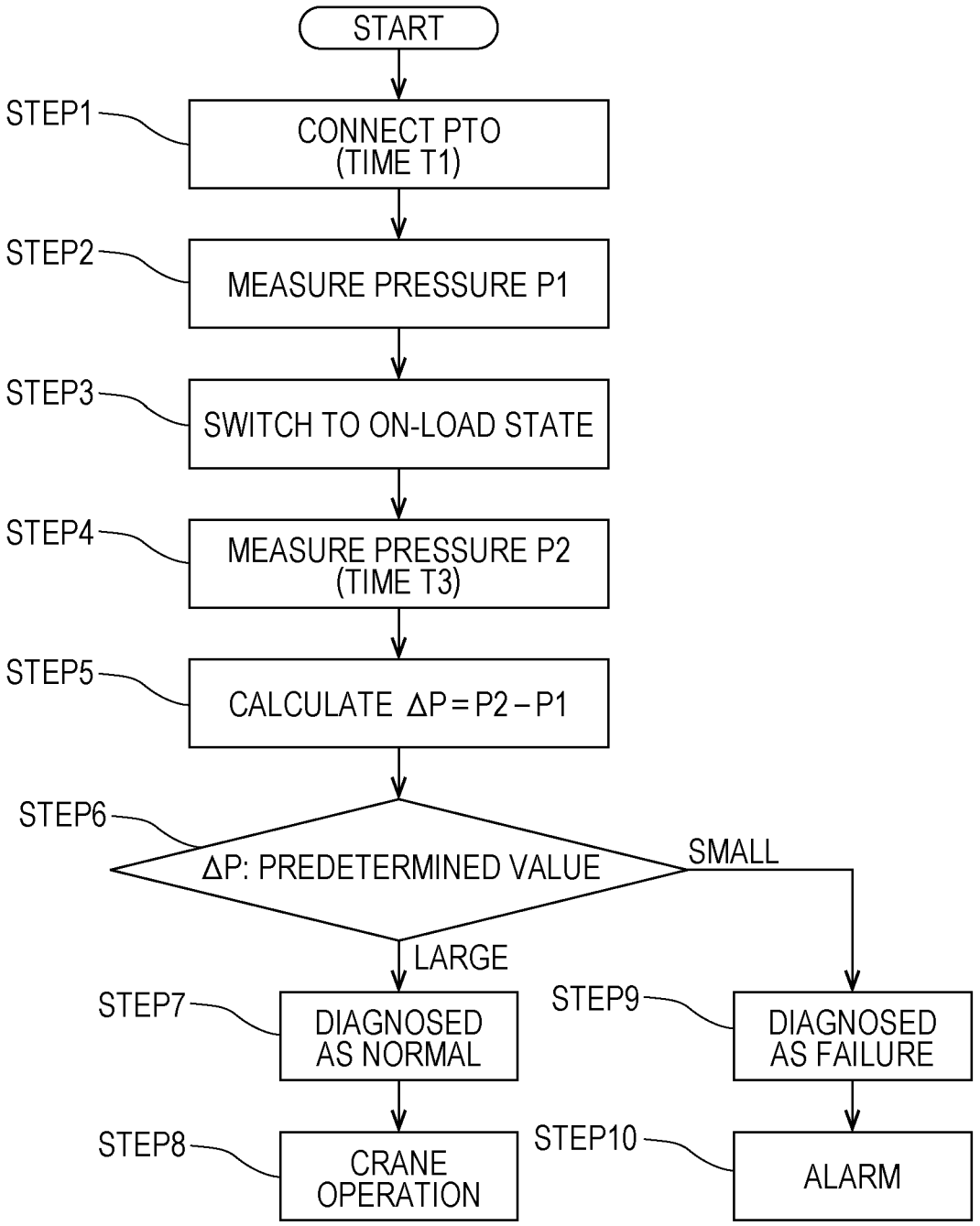
FIG. 3 is a flowchart for description of an operation of a failure diagnosis device for an unload circuit.

In addition, the controller 23 performs failure diagnosis of the unload circuit 1 based on the pressure signal from the pressure sensor 22. That is, the failure diagnosis device of the unload circuit 1 includes the controller 23 and the pressure sensor 22. The failure diagnosis of the unload circuit 1 will be described based on a flowchart illustrated in FIG. 3 and a graph illustrated in FIG. 4.

In STEP 1, the PTO 20 is connected to the engine 21. In this way, power of the engine 21 is transmitted to the hydraulic pump 4, and the hydraulic pump 4 starts to rotate (time T1 illustrated in FIG. 4). In this instance, the unloading solenoid valve 16 remains in a non-energized state of not being energized from the controller 23. For this reason, the unload circuit 1 is in the unloaded state.

In STEP 2, the pressure sensor 22 measures a pressure P1 of the pump oil passage 3 (hereinafter referred to as a "pump oil passage pressure P1") during unloading. The pump oil passage pressure P1 during unloading corresponds to a pump oil passage pressure when the unloading solenoid valve 16 is controlled such that the unload circuit 1 is in the unloaded state, and does not correspond to a pump oil passage pressure when the unload circuit 1 is actually in the unloaded state.

In the unloaded state, even though power of the engine 21 is transmitted to the hydraulic pump 4, the hydraulic oil is not supplied to the hydraulic actuator 8. Thus, the crane does not operate. Therefore, in the unloaded state, the engine 21 is in an idling state, and a discharge amount of the hydraulic pump 4 corresponds to an amount of hydraulic oil discharged by the hydraulic pump 4 during the idling state. In the idling state, the hydraulic oil from the hydraulic pump 4 returns to the hydraulic tank 7 through the parent valve 13 and the tank oil passage 6. When a pressure loss in the parent valve 13 is set to $\Delta p1$, and a pressure loss in the tank oil passage 6 is set to $\Delta p2$, a pump oil passage pressure $P1=\Delta p1+\Delta p2$ is generated from an oil pressure $p0=0$ in the hydraulic tank 7.

Figure 4:
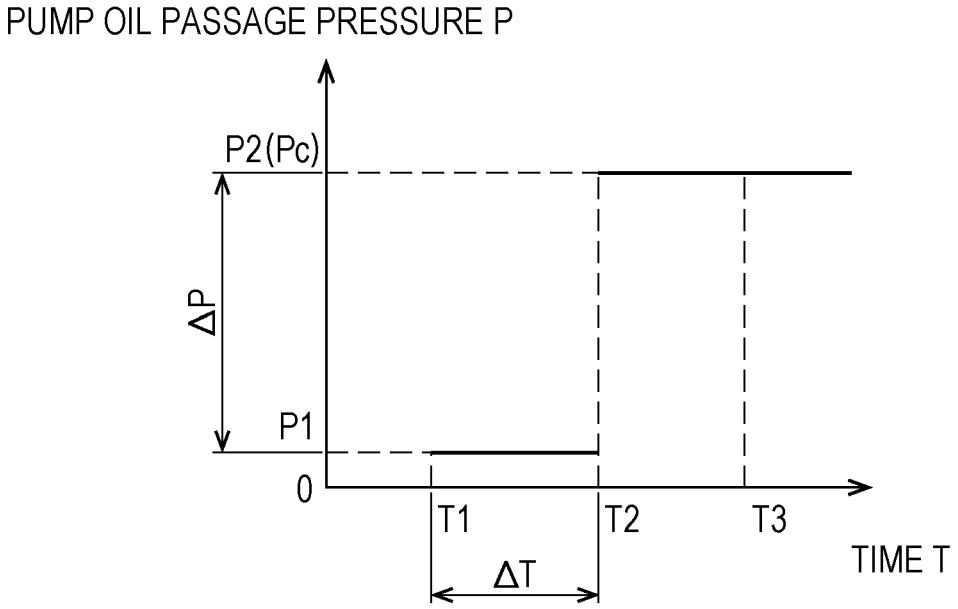
FIG. 4 is a graph of a pressure change of a pump oil passage at a start of pump drive.

As illustrated in FIG. 4, this unloaded state is continued for $\Delta T$ seconds. Specifically, the unloaded state is continued for a period of time from when the hydraulic pump 4 is driven by connecting the PTO 20 to the engine 21 and the hydraulic oil starts to be discharged to the pump oil passage 3 until the pump oil passage pressure P1 during unloading is stabilized. The controller 23 receives and stores a pressure signal indicating the pump oil passage pressure P1 measured by the pressure sensor 22.

Figure 5:
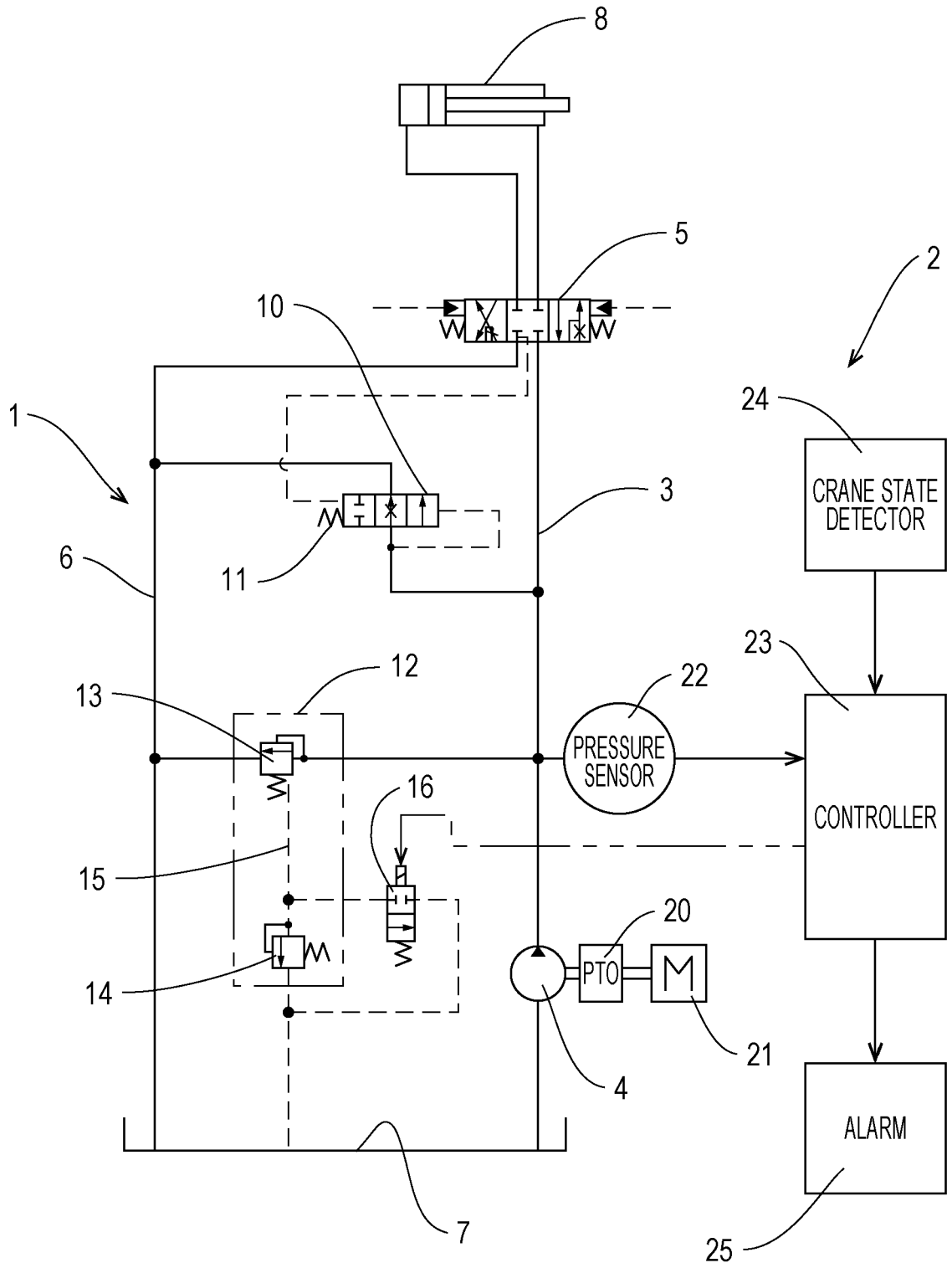
FIG. 5 is a diagram illustrating an on-load state of the unload circuit.

In STEP 3, the unload circuit 1 is switched to the on-load state (time T2 illustrated in FIG. 4). The unload circuit 1 switched to the on-load state is illustrated in FIG. 5. Specifically, the unloading solenoid valve 16 is energized from the controller 23, so that the unloading solenoid valve 16 is switched to the cutoff side. When the vent oil passage 15 and the hydraulic tank 7 are cut off, a pressure of the vent oil passage 15 rises, and the parent valve 13 of the pilot operated relief valve 12 is closed.

In the on-load state illustrated in FIG. 5, when the pressure of the pump oil passage 3 rises to a set pressure of the child valve 14 of the pilot operated relief valve 12, the child valve 14 opens to open the parent valve 13. In this way, the pilot operated relief valve 12 has a function as an original safety valve that releases the hydraulic oil in the pump oil passage 3 to the tank oil passage 6.

As illustrated in FIG. 5, the direction control valve 5 corresponds to a closed center type, and is in a neutral state in a state in which a pilot pressure is not supplied. Therefore, at a point in time (time T2 of FIG. 4) when the controller 23 switches the unload circuit 1 to the on-load state, hydraulic oil does not flow to the hydraulic actuator 8 via the direction control valve 5. Therefore, the engine 21 remains in the idling state.

The hydraulic oil discharged from the hydraulic pump 4 does not flow to the hydraulic actuator 8, and flows to the tank oil passage 6 from the pump oil passage 3 via the pressure compensating flow control valve 10. Since the pressure compensating flow control valve 10 is urged by a spring 11 toward a closing side, a pressure Pc (hereinafter referred to as a "compensation pressure Pc") for allowing hydraulic oil to flow through the pressure compensating flow control valve 10 by overcoming an urging force of the spring 11 is generated in the pump oil passage 3.

In STEP 4, the pressure sensor 22 measures a pump oil passage pressure P2 during on-loading. The pump oil passage pressure P2 during on-loading corresponds to a pump oil passage pressure when the unloading solenoid valve 16 is controlled such that the unload circuit 1 is in the on-load state, and does not correspond to a pump oil passage pressure when the unload circuit 1 is actually in the on-load state. It is preferable that the pump oil passage pressure P2 is measured after the pressure of the pump oil passage 3 is stabilized after the unload circuit 1 is switched to the on-load state. At time T3 illustrated in FIG. 4, the pump oil passage pressure P2 is measured by the pressure sensor 22, and a pressure signal thereof is sent to the controller 23.

In STEP 5, a differential pressure $\Delta P=P2-P1$ between the pump oil passage pressure P1 during unloading and the pump oil passage pressure P2 during on-loading, which are stored, is calculated inside the controller 23.

In STEP 6, the differential pressure $\Delta P$ is compared with a predetermined value inside the controller 23. The predetermined value is set based on a normal value of the pump oil passage pressure P2 during on-loading experimentally obtained in advance and a normal value of the pump oil passage pressure P1 during unloading. Specifically, the predetermined value is set to a value smaller than the differential pressure $\Delta P$ in a case in which the pump oil passage pressure P2 during on-loading is a normal value (compensation pressure Pc) and the pump oil passage pressure P1 during unloading is a normal value (low value) by an amount considering a measurement error.

When the differential pressure $\Delta P$ is larger than the predetermined value, the unload circuit 1 is diagnosed as normal in STEP 7. In this case, in STEP 8, the crane operation in the mobile crane 30 is possible.

When the differential pressure $\Delta P$ is less than or equal to the predetermined value, the unload circuit 1 is diagnosed as failure in STEP 9. In this case, in STEP 10, an alarm signal is sent from the controller 23 to the alarm 25. The alarm 25 issues an alarm, and the crane operation in the mobile crane 30 is impossible.

The following cases are assumed as causes of the failure.

For example, when the unloading solenoid valve 16 stops moving on the communication side (see FIG. 2) due to disconnection or contamination, the unloading solenoid valve 16 does not switch to the cutoff side even when the unloading solenoid valve 16 is energized, and thus remains in the unloaded state. Further, the pump oil passage pressure P2 measured at time T3 of FIG. 4 becomes equal to the pump oil passage pressure P1 during unloading. Therefore, the differential pressure $\Delta P$ becomes equal to or less than the predetermined value (specifically 0), and it is determined to be failed.

In addition, for example, when the unloading solenoid valve 16 stops moving on the cutoff side (see FIG. 5) due to disconnection or contamination, the unloading solenoid valve 16 does not switch to the communication side even when energization is stopped, and thus remains in the on-load state. Further, the pump oil passage pressure P1 measured during $\Delta T$ (from T1 to T2) illustrated in FIG. 4 becomes equal to the pump oil passage pressure P2 during on-loading. Therefore, the differential pressure $\Delta P$ becomes equal to or less than the predetermined value (specifically 0), and it is determined to be failed.

As described above, the unload circuit 1 includes the pump oil passage 3 for communication between the hydraulic pump 4 and the direction control valve 5, the tank oil passage 6 for communication between the direction control valve 5 and the hydraulic tank 7, the pressure compensating flow control valve 10 interposed between the pump oil passage 3 and the tank oil passage 6, the pilot operated relief valve 12 interposed between the pump oil passage 3 and the tank oil passage 6, and the unloading solenoid valve 16 interposed in the vent oil passage 15 of the pilot operated relief valve 12. The failure diagnosis device for the unload circuit 1 includes the pressure sensor 22 that measures the pressure of the pump oil passage 3 and the controller 23 that receives a pressure signal from the pressure sensor 22. The controller 23 performs failure diagnosis of the unload circuit 1 based on the differential pressure ΔP between the pump oil passage pressure P1 (first pump oil passage pressure) during unloading and the pump oil passage pressure P2 (second pump oil passage pressure) during on-loading.

Specifically, when the differential pressure ΔP is equal to or less than the predetermined value, the controller 23 diagnoses that the unload circuit 1 is failed.

Since the failure diagnosis device performs failure diagnosis of the unload circuit 1 based on the differential pressure ΔP, a pressure change due to a temperature change (viscosity change) is canceled, and it is possible to surely diagnose whether the unload circuit 1 is normally switched to the unloaded state or the on-load state. In addition, since diagnosis is performed using the differential pressure ΔP, it is possible to surely perform failure diagnosis without being affected by a variation in characteristic of the pressure sensor 22. Therefore, it is ensured that automatic suspension by the safety device 2 of the mobile crane 30 is surely performed, and thus safety and reliability of the mobile crane 30 are remarkably improved.

In addition, the controller 23 performs failure diagnosis of the unload circuit 1 on condition that the hydraulic pump 4 starts to be driven. That is, since failure diagnosis of the unload circuit 1 is automatically performed on condition of a connection operation of the PTO 20, which is surely performed at the time of entering the crane operation, it is possible to surely find failure of the unload circuit 1 as a pre-operation inspection.

Further, the hydraulic pump 4 is driven via the PTO 20, and the controller 23 performs failure diagnosis of the unload circuit 1 based on the differential pressure between the pump oil passage pressure P1 (first pump oil passage pressure) after the unloaded state is maintained for a predetermined time and the pump oil passage pressure P2 (second pump oil passage pressure) after switching to the on-load state after the hydraulic pump 4 starts to be driven. In this way, the differential pressure ΔP is calculated using the pump oil passage pressure P1 in a stable state, not the pump oil passage pressure P1 in an unstable state immediately after the hydraulic pump 4 is driven, and thus it is possible to prevent erroneous diagnosis.

Even though the invention made by the inventor has been concretely described based on the embodiment, the present invention is not limited to the above-described embodiment, and may be modified within a range not departing from a subject matter thereof.

For example, in the embodiment, a description has been given of the hydraulic system that drives the hydraulic actuator 8 (the derricking cylinder 37) of the mobile crane 30. However, the present invention may be applied to a hydraulic system of another actuator (for example, a telescopic cylinder). In addition, the present invention may be applied to a hydraulic system of a construction machine other than the mobile crane.

In addition, for example, in the embodiment, a diagnosis example corresponding to a case in which the engine is in the idling state has been described. However, revolutions per minute (RPM) of the engine during failure diagnosis may not correspond to RPM at the time of idling. That is, even when the pump oil passage pressures P1 and P2 change with an increase in pump discharge amount due to an increase in engine RPM, if the change is smaller than the differential pressure ΔP, failure diagnosis of the unload circuit is possible similarly to the embodiment.

It should be considered that the embodiment disclosed this time is illustrative and not restrictive in all respects. The scope of the present invention is defined not by the above description and by the scope of the claims, and it is intended that all modifications within meaning and scope equivalent to the claims are included.

REFERENCE SIGNS LIST

1 Unload circuit
2 Safety device
3 Pump oil passage
4 Hydraulic pump
5 Direction control valve
6 Tank oil passage
7 Hydraulic tank
8 Hydraulic actuator
10 Pressure compensating flow control valve
12 Pilot operated relief valve
15 Vent oil passage
16 Unloading solenoid valve
20 PTO
22 Pressure sensor (failure diagnosis device)
23 Controller (failure diagnosis device)

The invention claimed is:

1. An unload circuit for returning hydraulic oil from a hydraulic pump to a hydraulic tank with no load, the unload circuit comprising:

a pump oil passage that connects between the hydraulic pump and a direction control valve, a tank oil passage that connects between the direction control valve and the hydraulic tank, a pressure compensating flow control valve interposed between the pump oil passage and the tank oil passage, a pilot operated relief valve interposed between the pump oil passage and the tank oil passage, an unloading solenoid valve interposed in a vent oil passage of the pilot operated relief valve, a pressure sensor that measures a pressure of the pump oil passage; and a controller that controls an energizing state of the unloading solenoid valve and that receives a pressure signal from the pressure sensor, wherein the controller performs failure diagnosis of the unload circuit based on a differential pressure between a first pump oil passage pressure measured by the pressure sensor during an unloaded state when the controller controls the unloading solenoid valve to a first energizing state and a second pump oil passage pressure measured by the pressure sensor during an on-load state when the controller controls the unloading solenoid valve to a second energizing state.

2. The unload circuit according to claim 1, wherein the controller diagnoses that the unload circuit is failed when the differential pressure is equal to or less than a predetermined value.

3. The unload circuit according to claim 1, wherein the controller performs failure diagnosis of the unload circuit on condition that the hydraulic pump starts to be driven.

4. The unload circuit according to claim 3, wherein the hydraulic pump is driven via a power take-off (PTO), and the controller performs failure diagnosis of the unload circuit based on a differential pressure between the first pump oil passage pressure after the unloaded state is maintained for a predetermined time and the second pump oil passage pressure after switching to the on-load state after the hydraulic pump starts to be driven.

* * * * *